US005193517A

United States Patent [19]

Taylor et al.

[11] Patent Number: 5,193,517

[45] Date of Patent: Mar. 16, 1993

[54] GAS SPRING AIRGUN

[75] Inventors: Hugh F. Taylor, Sawston; David R. Theobald, St. Ives, both of England

[73] Assignee: Utec B.V., Netherlands

[21] Appl. No.: 713,439

[22] Filed: Jun. 10, 1991

[51] Int. Cl.[5] ..... F41B 11/00

[52] U.S. Cl. ..... 124/67; 124/65

[58] Field of Search ..... 124/63-68, 124/69

[56] References Cited

U.S. PATENT DOCUMENTS

| | | | |
|---|---|---|---|
| 2,101,198 | 12/1937 | Robinson | 124/69 |
| 2,145,277 | 1/1939 | Reardon | 124/66 X |
| 2,652,821 | 9/1953 | Fitch | 124/69 X |
| 4,709,686 | 12/1987 | Taylor et al. | 124/67 |
| 4,771,758 | 9/1988 | Taylor et al. | 124/68 |
| 4,850,329 | 7/1989 | Taylor et al. | 124/66 X |
| 4,870,945 | 10/1989 | Hutchison | 124/68 |

FOREIGN PATENT DOCUMENTS

| | | | |
|---|---|---|---|
| 469875 | 8/1975 | U.S.S.R. | 124/65 |
| 1126806 | 11/1984 | U.S.S.R. | 124/63 |
| 2110348 | 6/1983 | United Kingdom | 124/63 |

*Primary Examiner*—Randolph A. Reese
*Assistant Examiner*—Jeffrey L. Thompson
*Attorney, Agent, or Firm*—Lee, Mann, Smith, McWilliams, Sweeney & Ohlson

[57] ABSTRACT

A gas spring airgun in which the power system comprises a main cylinder which contains a piston and a hollow dummy piston. The piston is a sliding fit within the main cylinder while the dummy piston is fixed relative to the main cylinder, and is of considerably small diameter. A collar is located in the space between the dummy piston and the piston and is substantially fixed relative to the piston and slidable relative to the dummy piston, when the system is pressurized.

19 Claims, 3 Drawing Sheets

GAS SPRING AIRGUN

BACKGROUND OF THE INVENTION

The present invention relates to spring-powered air weapons or airguns in which the spring consists of a sealed gas charge as disclosed in GB-B-2084704. The inventors of the subject invention, who are also responsible for the invention identified above and have been responsible for a number of other highly beneficial and successful inventions (e.g. U.S. Pat. Nos. 4,771758 and 4,850,329) in the field of spring-operated airgun power systems and affecting, amongst other things, airgun efficiency, have been making a range of airguns incorporating sealed gas springs for many years. Their products are sold under the Trade Mark "THEOBEN".

Although there are many different systems for powering airguns, such as those involving either precharged tanks of compressed air at pressures of up to about 200 bar (20 MPa) or containers of liquified carbon dioxide which will boil off to produce a substantially constant pressure of about 60 bar (6 MPa), the most popular system by far is one in which the airgun incorporates a self-contained energy storage system whereby a single, manual, cocking stroke will create a quantity of stored energy which can subsequently be released when desired, by means of a trigger mechanism, to discharge a projectile. It will readily be appreciated that, if the airgun is to be fired reasonably frequently by persons of average strength, the single manual stroke referred to will not and cannot involve very large amounts of energy. Or, to put it another way, the gross energy input per shot is perforce quite modest and, therefore, the overall efficiency of the airgun power system, i.e. the efficiency with which the work done in cocking the airgun is converted into kinetic energy in the projectile when released, is of considerable importance. Unlike cartridge firearms, single-stroke airguns have only a modest amount of energy input available to start with so, unless the process of conversion is reasonably efficient, the power of the airgun will be extremely low.

DE-C-1553962 discloses an air weapon in which the energy projecting the pellet is achieved through a gas spring. However, the constructional details of the gas spring are not discussed; the specification merely refers to a gas spring consisting of a spring cylinder and a displacement body, such springs being known per se. Later, it is suggested that the displacement body might consist of a cylindrical piston rod. In the absence of any specific constructional details, it might be assumed that the gas spring is of a conventional design and consists of a cylinder, a piston slidingly sealed to the inside wall of the cylinder and a piston rod rigidly attached to the piston. The variable-volume sealed space between the piston crown and the inside on the cylinder defines the working gas chamber which will be under pressure. Behind the piston there will be a rear chamber which must be open to allow air to escape when the cylinder shoots forward upon firing. The cylinder itself, of course, constitutes the piston which slides within the airgun compression chamber behind the pellet. Such a construction would exhibit a very considerable compression ratio in moving the piston crown in its sliding cylinder from the uncocked to the cocked position.

The volume occupied by the gas in the sealed working gas chamber is reduced to a very small value when the system is cocked whereas the volume of the sealed working gas chamber represents almost the entire volume of the cylinder itself when the system is in the uncocked position. Thus, the compression ratio in this gas spring may be as high as 8 or 10. There are two practical effects in having a high compression ratio. Firstly, the effort required to move the piston from the uncocked to the cocked position increases markedly as the working gas is compressed.

The second disadvantage in having a high compression ratio is that the force which causes the piston to accelerate down the compression chamber when released by the trigger is far from uniform. At high power levels, the flow of hot, compresseed air produced by this non-uniform acceleration appears to be likely to deform the pellet and thereby impair accuracy.

It will also be noted that DE-C-1553962 does not contemplate any means of varying the uncocked gas pressure in any given unit. Nevertheless, changes in performance are allegdly to be achieved by changing the entire gas spring assembly.

FIGS. 1 and 2 are simplified illustrations of an airgun containing a sealed gas spring in accordance with GB-B-2,084,704. FIG. 1 shows the airgun in the cocked condition, i.e. with the main piston 28 held in its rearmost position by a trigger mechanism 60. The airgun consists of a barrel 10 whose breech communicates with a compression chamber 25 via a transfer port 24. The main cylinder 26 contains a piston 28 which consists of a hollow tube 30 sealed at one end by a piston crown 32. The tube 30 of the piston 28 is a sliding fit over a static cylinder (or "dummy piston") 36 with a seal between the inner bore of tube 30 and the outer bore 38 of dummy piston 36. Thus a sealed space of 52 of variable volume is created which communicates with a sealed space 52A via the bore 44 in the dummy piston 36.

FIG. 2 shows the same airgun, further simplified, in the fired condition. Thus the piston 28 has moved to the left so as to compress the air in the compression chamber 25, forcing it through the transfer port 24 and out of the barrel, taking the projectile with it. It will be appreciated that the sealed, variable volume chamber 52 + 52A can be pre-charged with gas at a pressure substantially higher than ambient. In practice, a pressure of about 20 bar (2 MPa) has been found to suit most applications. Clearly the pressure in the sealed chamber will rise pro rata to the reduction in its volume as the piston is forced back during the cocking stroke. Typically the volume of 52 + 52A when fully cocked will be about ⅔rds of its volume when uncocked, i.e. a compression ratio of approximately 1.5:1. The pressure in the sealed chamber will rise in inverse proportion to the reduction in volume and is thus likely to be of the order of 30 bar (3 MPa) when the airgun is cocked.

A potential disadvantage of the sealed gas spring system without the present invention, is that it is, in effect, a variable-rate spring for, as the volume decreases during the cocking stroke and the pressure rises, so the additional force required to move the piston a further given distance also increases, whereas a uniform metal coil spring should have a substantially constant spring rate and so the additional cocking force per unit of distance will remain substantially constant through the travel of the piston. This disadvantage can, however, be ameliorated to some extent by skilful arrangement of the pivoting geometry of the cocking mechanism so as to achieve an increasing mechanical advantage during the stroke.

It may be helpful to give some indication of the levels of efficiency involved. A fairly typical conventional airgun, incorporating a metal coil spring in place of the sealed gas spring of the Theoben System, may have an overall efficiency in the range of 10% to 15%. Existing Theoben air riffles, incorporating the inventions of the present inventors as identified above but without the subject invention, can reach efficiencies of up to about 20%. By way of contrast, a multi-stroke pneumatic airgun, e.e. an airgun incorporating a self-contained pump which may be operated many times to compress increasingly a charge of air which, generally, will all be substantially released to force the projectile out of the barrel when the trigger is operated, may have an overall efficiency of only 1 or 2%.

From all the above it will be appreciated that the search for energy efficiency in a single-stroke spring airguns has been under way ever since this class of airgun became popular in the latter part of the 19th century. Certainly it has been a major goal of the present inventors for the past decade and one at which they have already been proved to be extremely successful.

Nevertheless, the inventors have, on some occasions, been unable to achieve the desired power output when converting, for example, another manufacturer's rifle with a relatively small compression chamber capacity, to their sealed gas spring system. In addition, when attempting to produce very high power outputs from their own rifles, increasing the pre-cocked pressure in the sealed gas chamber has repeatedly been found to have only a limited and non-linear effect. Thus, for any given set of compression chamber dimensions, increasing the pre-cocked pressure from its normal level, in small, uniform steps, will have a general tendency to increase the performance of the rifle in a corresponding series of steps which grow smaller and smaller and eventually decrease to nothing. During this process the firing action of the rifle will tend to become increasingly harsh and unpleasant. If the pressure is increased even further, the cocking effort will continue to increase very noticeably and yet the kinetic energy transferred to the projectile may actually decrease. Thus, the overall efficiency with which the cocking effort is converted into kinetic energy in the projectile will drop rapidly with increasing pressure.

This general pattern tends to occur in coil spring airguns as well, in that if more and more powerful springs are fitted, the cocking effort increases pro-rata, the gun becomes harsh to fire and small initial power increases rapidly diminish with further increases in spring strength until they cease altogether and the power may even start to decrease.

It is believed that one of the principal reasons why the efficiency of an airgun built in accordance with GB-B-2,084,704 should start to decrease once the pre-cocked pressure in the sealed chamber is increased past a given point, is probably because the higher pressure increases the frictional drag of the seal which usually consists of one or more O-rings or other seals, mounted in either the inner bore of the piston and sliding on the outer surface of the dummy piston, or in the outer bore of the dummy piston and sliding on the inner surface of the piston, faster than the increased pressure increases the forces tending to accelerate the piston down the compression chamber. It is a general rule that the higher the pressure acting on an O-ring seal, the greater will the force with which the O-ring grips the member on which it is sliding. Other things being equal, the greater the diameter of the circle of contact between the O-ring and the surface on which it is sliding, the greater the frictional drag, since the length of the contact surface between the O-ring and the surface in sliding contact with it, will be directly proportional to the diameter of the O-ring.

It is highly likely that there are various other complex factors involved in the overall reduction in efficiency, probably including the rapid heating of the air in the compression chamber during the firing stroke and the flow dynamics of this hot, compressed air through the transfer port and into the barrel. Nevertheless the subject invention has produced substantial benefits without further development of the compression chamber or transfer port.

SUMMARY OF THE INVENTION

According to the present invention, there is provided an air weapon for launching a projectile from the barrel by means of a charge of compressed air, comprising: an outer cylinder having one end in communication with the barrel; an inner cylindrical member located within the outer cylinder to define a coaxial cylindrical clearance therebetween; a hollow piston axially movably located within the outer cylinder between a cocked and uncocked position, the piston having a cylindrical piston wall extending rearwardly from the piston crown into the cylindrical clearance, the rapid movement of the piston from the cocked position into the uncocked position being capable of compressing a charge of air to expel the projectile; a cocking mechanism for retracting the piston towards the inner cylindrical member into the cocked position thereby compressing gas within the hollow piston; and a trigger for releasing the piston from the cocked position whereupon the compressed gas within the hollow piston acts as a gas spring to force the piston into the uncocked position thereby compressing air before the piston crown to expel the projectile; first annular sealing means being located between the inner piston wall surface and the outer wall of the inner cylinder to provide a gas-tight expansion chamber behind the piston crown whereby retraction of the piston into the cocked position compresses gas within the entire expansion chamber and release of the piston allows the energy stored in the compressed gas in the entire expansion chamber to force the piston rapidly forward and compress the air before the piston crown; characterised in that a compression ratio between the uncocked and cocked state of between 1.05:1 and 1.25:1 is achieved by the fact that the inner cylindrical member (or "dummy piston") has an external diameter which is significantly smaller than the internal diameter of the piston wall.

Preferably, the inner cylindrical member has an extended diameter which is between 75% and 20%; preferably between 60% and 30%, more preferably, between 55% and 40%, for example about 50% of the internal diameter of the piston wall. Preferably, the combined effect of the reduced diameter dummy piston and the length of the cocking stroke will be such as will result in a compression ratio in the region of 1.1:1, for example 1.15:1. In a preferred embodiment, there is a collar located between the inner cylindrical member and the piston wall, and seals are positioned respectively between the inner cylindrical member and the collar and between the collar and the piston wall. Conveniently, the respective seals each comprises a pair of O-rings.

Preferably, the inner cylindrical member is a cylinder having a closed end and an open end, the open end of the inner cylinder being relatively closer to the barrel than the closed end, the piston interior being in communication with the interior of the inner cylinder via the open end of the inner cylinder. Alternatively, the inner cylindrical member is solid.

Preferably, the gas in the expansion chamber is at a substantially higher pressure than atmosphere when the piston is in the uncocked position. Preferably, the cocking mechanism includes a cocking lever which is arranged to urge the piston to the cocked position. In a preferred form, the barrel is pivotable and the cocking lever is linked to the barrel whereby the barrel constitutes a convenient form of extended lever to apply a cocking force to the piston via the cocking lever. There may also be a refill valve which is in communication with the expansion chamber, rendering the expansion chamber chargeable with a gas under pressure.

The invention is also applicable to a double-piston type of design in which the two pistons travel in opposite directions simultaneously along the same axis upon firing.

The essence of the present invention may therefore be considered to comprise an assembly consisting of a main piston, dummy piston and sealing means between the two, in which the effective diameter of the sliding sealing means between the main piston and dummy piston is very much smaller than the effective diameter of the inside of the main piston. This has the effect of greatly reducing the compression ratio between the uncocked and cocked states, a consequence of which is to reduce the rate at which the cocking effort increases during the cocking stroke.

It may be helpful to address the theory of what would happen if the diameter of the dummy piston were steadily reduced still further. Clearly the compression ratio would also reduce until, when the diameter of the dummy piston became infinitely small, the compression ratio would be unity. The other major force consideration would appear to be the frictional drag of the O-rings between the collar and dummy piston. Other things being constant, the change in this friction will be a function of the pressure and the diameter of the O-rings(s). Therefore, as the diameter of the dummy piston decreases, the frictional drag will also decrease until it disappears altogether when the diameter is infinitely small. At that point the compression ratio will be unity, no work will be done during the cocking stroke, no energy stored and the gun will not work.

Extended testing of prototypes with a wide range of different pressures in the sealed chamber and different diameters of dummy piston, as well as changes to the many other variables, would be necessary in order to establish the optimum settings, but the present indications are that greatly improved efficiency is achieved with the diameter of the dummy piston at approximately half the diameter of the inside bore of the piston and with the uncocked pressure at around 60 bar (6 MPa).

Some of the advantages of the present invention compared to the known construction might be considered to include:

1. Rather than making and finishing either the inside bore of the piston or the outside of a large dummy piston to a very high standard, a very much smaller surface area i.e. that of the new smaller dummy piston, has to be finished to this high standard.

2. The cocking effort is very much more uniform throughout the stroke, thus reducing the need for sophisticated cocking lever geometry.

3. The force causing the piston to accelerate down the compression chamber when released by the trigger is also much more uniform and, particularly at high power levels, this more uniform acceleration appears to be less likely to deform the pellets and will therefore improve accuracy.

4. Sealed, replacement power units can be shipped fully assembled but unpressurised for simple replacement as a complete sub-assembly and then pressurised very easily after assembly.

5. The overall efficiency is very significantly improved; in some configurations it is probably as high as 30%, which represents an increase by a factor of about 50% on the already high level achieved with the inventors' previous sealed gas spring systems.

6. The performance effect of increasing the static pressure appears to be very much more linear; this is a very advantageous feature to a manufacturer because of the many different power requirements of different markets. If widely different performances can readily be obtained from an otherwise unchanged airgun, simply by altering the static pressure, this will provide very welcome manufacturing flexibility and the ability to meet a variety of market demands easily, quickly and accurately.

DESCRIPTION OF PREFERRED EMBODIMENTS

The invention may be carried into practice in various ways and some embodiments will now be described by way of example with reference to FIGS. 3 to 7 of the accompanying drawings in which.

Figure 1:
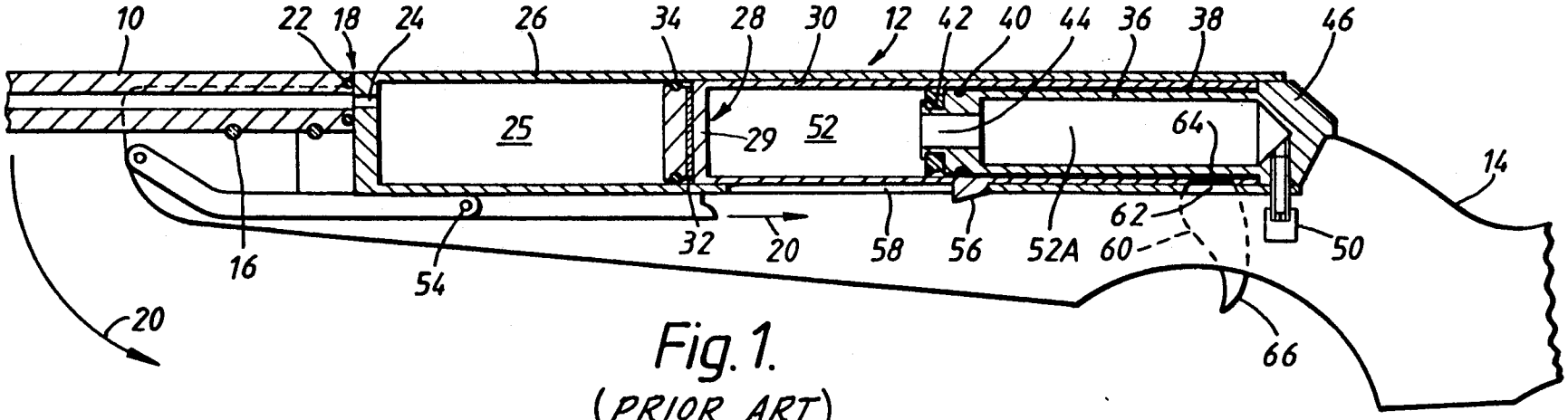
Fig. 1. (PRIOR ART)
Figure 2:
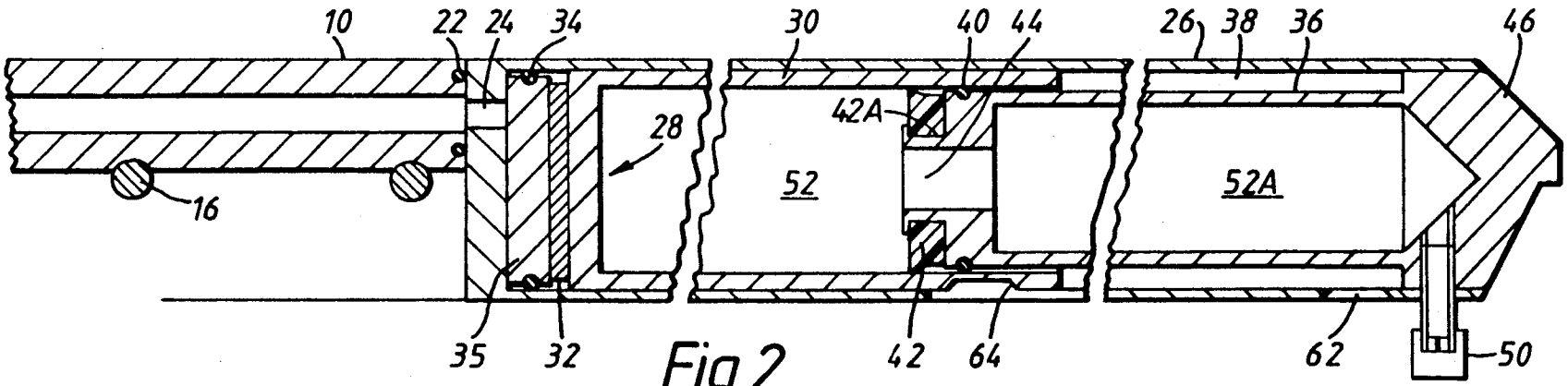
Fig. 2. (PRIOR ART)
Figure 3:
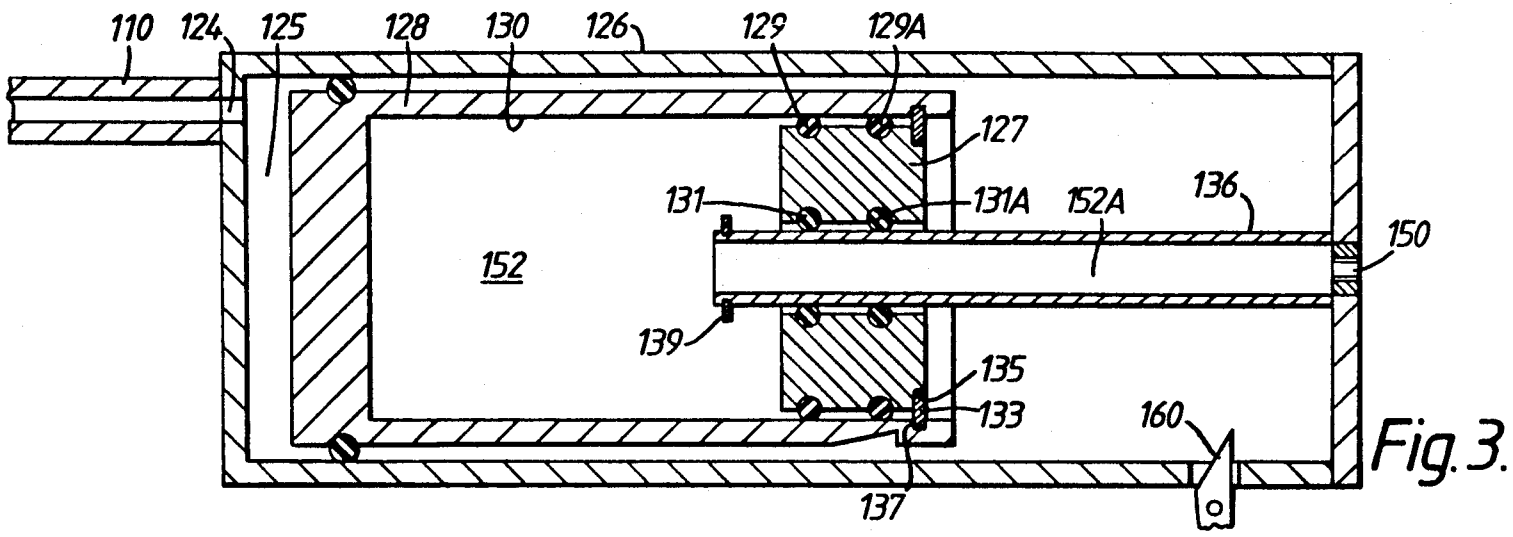
FIG. 3 is a schematic partial vertical cross-section through an air weapon in accordance with the present invention in the uncocked state.
Figure 4:
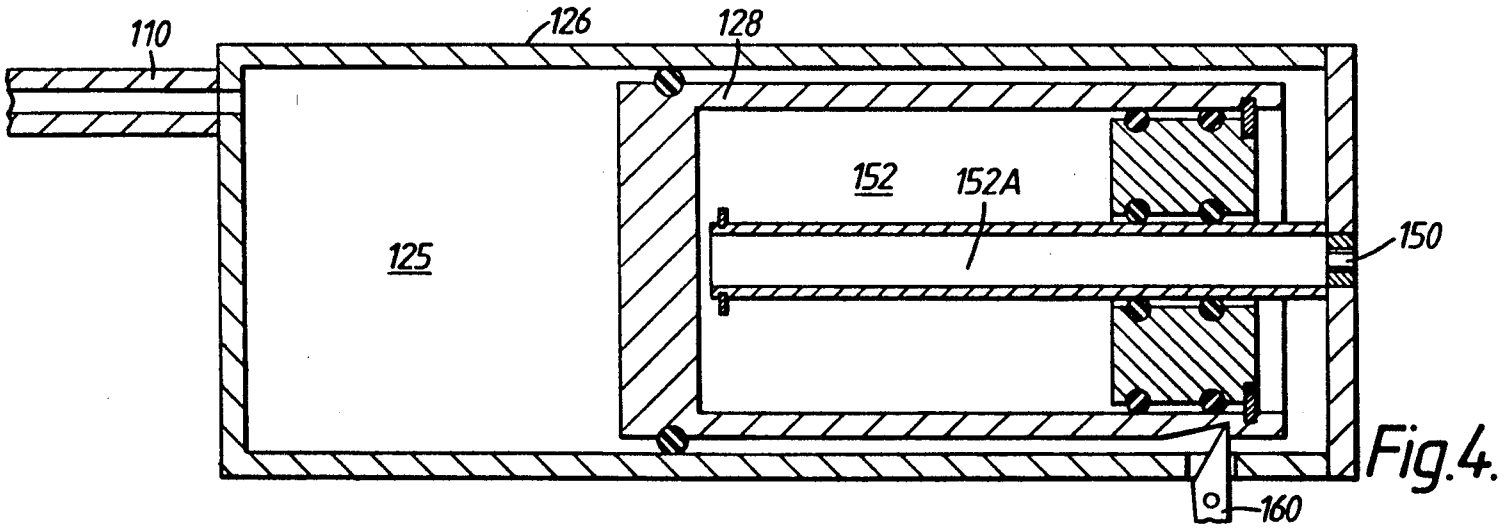
FIG. 4 is a similar view showing the weapon in the cocked state.

The embodiment of FIGS. 3 and 4 is a modified form of the construction shown in FIGS. 1 and 2. Generally equivalent components have similar numerals except that they are in the "100" series.

The barrel 110 is connected to the power system via the breech 124. The power system comprises a main cylinder 126 which contains a piston 128 and a hollow dummy piston 136. The piston 128 is a slidable fit within the main cylinder 126 while the dummy piston 136 is fixed relative to the main cylinder 126, and is of considerably small diameter. A collar 127 is located in the space between the dummy piston 136 and the piston 128.

The inner diameter of the hole through the centre of collar 127 is just sufficiently larger than the outer diameter of dummy piston 136, to accommodate a pair of O-ring seals 131 and 131A and the outer diameter of the collar 127 is just sufficiently smaller than the inner diameter 130 of the piston 128 to accommodate a further pair of O-ring seals 129 and 129A. To allow for the assembly and retention of the collar 127, a circlip groove 137 is made in the inner wall 130 of piston 128 adjacent the open end of the piston 128. A rebate 135 is created in the outer rear face of the collar 127 to match the circlip 133, which is located in the groove 137 after the collar 127 has been inserted in piston 128. An additional circlip 139 may be mounted in a groove on the outside of the open end of the dummy piston 136 for security and to allow pressure testing as a sub-assembly.

Once the power unit has been assembled, the sealed variable-volume space 152 + 152A can be charged to any desired pressure via a valve 150 and this pressure will ensure that the collar 127 is pushed firmly up against the circlip 133 and will remain in that position substantially static in relation to the piston 128 for as long as the pressure s maintained. In this position, the rebate 135 will prevent the circlip 133 from leaving the groove 137. This effective interlock ensures security and safety and prevents dismantling from taking place without the pressure in the space 152 + 152A being reduced first via the valve 150. Thus the preferred embodiment of collar 127 is simple and beneficial, while permitting the diameter of dummy piston 136 to be very much smaller than the inside diameter of piston 128 and allowing rapid assembly and safe dismantling. This substantial difference in diameters enables very low compression ratios to be achieved since, for any given stroke, they will be determined by the relationship between the squares of the two diameters.

FIG. 3 shows the system in the fired or uncocked state. The piston 128 is in the forward position and the volume of compression chamber 125 is at a minimum. FIG. 4 shows the same embodiment in the cocked position in which the piston 128 is held in its rearmost position by a trigger mechanism 160. The differences between the embodiment shown in FIG. 1 and 2 and that shown in FIGS. 3 and 4 will now become more apparent.

The compression ratio achieved in the variable-volume sealed chamber will be the total of the volume 152 + 152A when the piston 128 is fully forward, divided by the reduced volume of 152 + 152A when the piston 128 is in the cocked position. In the embodiment shown in FIGS. 1 and 2 the reduction in volume of space 152 during the cocking stroke is substantial, perhaps of the order of a half. Thus the compression ratio will be approximately 3/2 or 1.5. By contrast, FIGS. 3 and 4 show that a small diameter dummy piston 136 dramatically reduces the compression ratio, since the space 152 is only reduced during the cocking stroke by the volume of the dummy piston 136 which projects into space 152 by the end of the cocking stroke. In a preferred configuration as indicated in FIGS. 3 and 4, this compression ratio would be of the order of 1.1:1, although in practice a ratio of about 1.15:1 has also been found to be very satisfactory.

Since a compression ratio of unity represents zero compression it will be appreciated that compression ratios of the order of 1.1:1 and 1.15:1 represent a reduction of 70/80% on the typical compression ratio of 1.5:1 taught by GB-B-2084704 and might reprepresent an even more massive reduction of perhaps 95/97% on the compression ratio likely to be achieved in DE-C1553962.

This greatly reduced compression ratio has the effect of producing a corresponding reduction in the rate at which the cocking effort increases during the cocking stroke.

Another consequence of the reduced diameter of the dummy piston is a dramatic reduction in the net area on which the pressure in the sealed chamber 152 + 152A acts to urge the piston 128 down the compression chamber 125. In any such assembly this area will be the cross-sectional area of the exit hole, which in this case will be the cross-sectional areas of a circle whose diameter is the outer diameter of the dummy piston 136. As a result of this loss of "effective" area, in order to produce the same force urging the piston 128 down the compression chamber, the pressure must be increased by a corresponding factor. Thus, by way of example, if the diameter of the dummy piston 136 is reduced by a half, its cross-sectional area will be reduced to one quarter and, in consequence, a four-fold increase in pressure will be necessary to produce approximately the same force (disregarding frictional changes).

Fortunately, as a result of the greatly reduced compression ratio, the pressure can be increased considerably without making the cocking effort too heavy.

Figure 5:
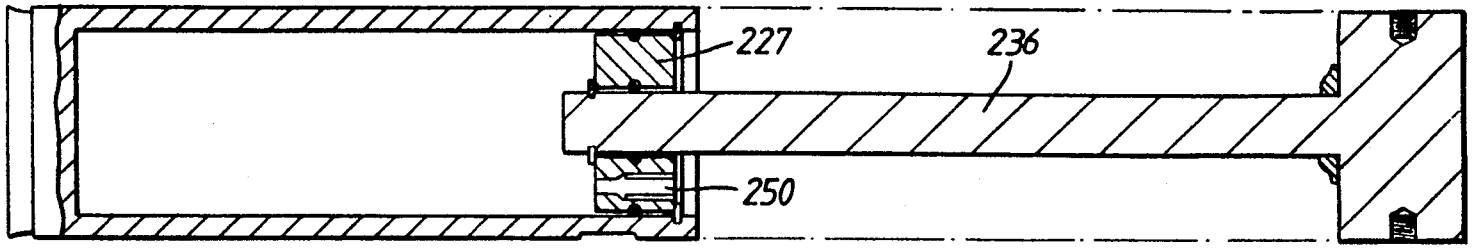
FIG. 5 is a view similar to FIG. 3 showing another embodiment.

FIG. 5 shows a similar but alternative embodiment which employs a small diameter, solid dummy piston 236. The rear of the piston 228 is open, allowing access to the collar 227 in which a charging valve 250 is mounted. This will have the effect of increasing the compression ratio slightly, while still keeping a low frictional drag from the O-rings. The remainder of the arrangement has been omitted from the drawing for clarity but is similar to the previously described constructions.

Figure 6:
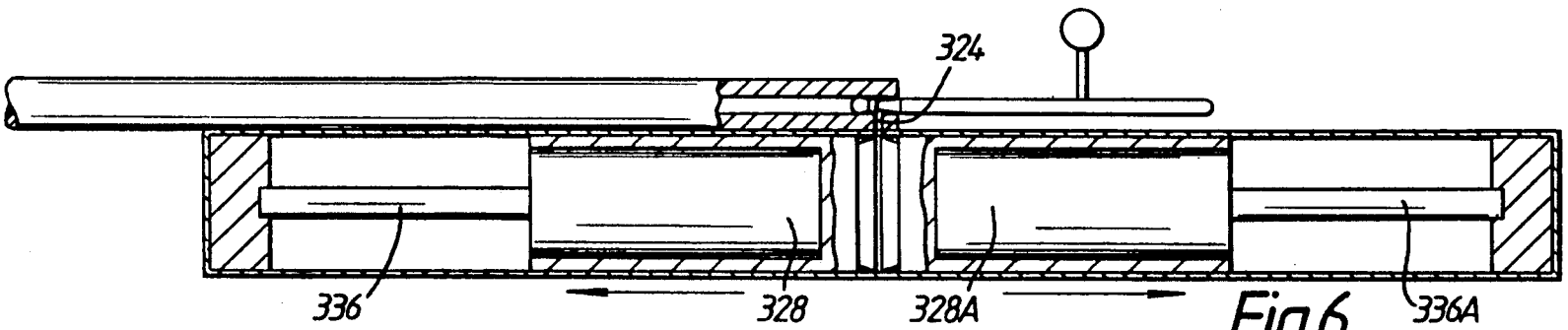
FIGS. 6 and 7 are view similar to FIG. 5 showing two alternative embodiments, each employing two opposed pistons.
Figure 7:
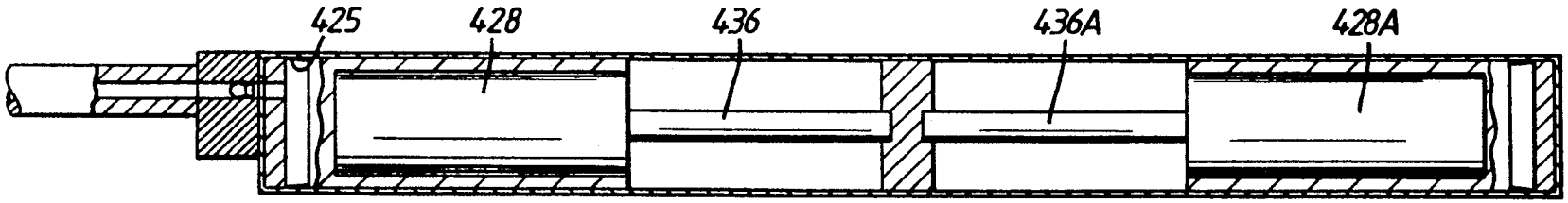

FIGS. 6 and 7 show the invention applied in two "contra-piston" embodiments in which there are two pistons which travel in opposite directions on firing and which represent a means of counteracting recoil (see GB-B-2,149,483 for earlier work in this area). In FIG. 6, the two pistons 328,328A are forced away from each other during the cocking stroke. When the weapon is fired, they move rapidly towards one another, compressing the air between them and forcing it out of a radial transfer port 324 and into the barrel. The two dummy pistons 336,336A are shown as solid, but could be hollow.

In the layout shown in FIG. 7, the pistons 428,428A are forced together during the cocking stroke and fly apart when fired. In this particular case, the left-hand piston 428 in the drawing does useful work by compressing the air in the compression chamber 425 and forcing it down the barrel while the right hand piston 428A is simply a counter-weight, intended to reduce any movement of the weapon to a minimum during the firing stroke. Again the two dummy pistons 436,436A are shown as solid but could be hollow. They are fixed to a central support.

We claim:

1. An airgun for launching a projectile from a barrel by means of a charge of compressed air, comprising: an outer cylinder having one end in communication with said barrel; an inner cylindrical member located within said outer cylinder to define a coaxial cylindrical clearance therebetween; a hollow piston axially movably located within said outer cylinder between a cocked and uncocked position, said piston having a crown and a cylindrical piston wall extending rearwardly from said piston crown into said cylindrical clearance, rapid movement of said piston from said cocked to said uncocked position being adapted to compress a charge of air to expel said projectile; a cocking mechanism for retracting said piston towards said inner cylindrical member into said cocked position thereby compressing gas within said hollow piston; and a trigger for releasing said piston from said cocked position, whereupon said compressed gas within said hollow piston acts as a gas spring to force said piston into said uncocked position, thereby compressing air before said piston crown to expel said projectile; first annular sealing means being located between an inner piston wall surface and an outer wall of said inner cylinder to provide a gas-tight expansion chamber behind said piston crown whereby retraction of said piston into said cocked position compresses gas within the entire expansion chamber and release of said piston allows energy stored in said compressed gas in said entire expansion chamber to force the piston rapidly forward and compress the air before the piston crown; said inner cylindrical member having an external diameter which is significantly smaller than the internal diameter of said piston wall, thereby achieving a compression ratio between said cocked and uncocked positions of between 1.05:1 and 1.25:1.

2. An airgun according to claim 1, wherein said inner cylindrical member has an external diameter which is between 75% and 20% of the internal diameter of said piston wall.

3. An airgun according to claim 1, wherein said inner cylindrical member has an external diameter equal to about half that of the internal diameter of said piston wall.

4. An airgun according to claim 1 wherein said first annular sealing means is statically located relative to said inner piston wall surface and slidable relative to said outer wall of said inner cylinder.

5. An airgun according to claim 4, wherein said respective seals each comprises a pair of O-rings.

6. An airgun according to claim 1 including a collar located between said inner cylindrical member and said inner piston wall and seals positioned respectively between said inner cylindrical member and said collar, and between said collar and said inner piston wall.

7. An airgun according to claim 6, wherein said collar is retained in a substantially static relationship with said piston, but a sliding relationship with said inner cylinder when the system as a whole is under pressure.

8. An airgun according to claim 6, wherein said inner wall of said piston has a groove and a circlip is located in said groove, thereby retaining said collar within said piston, and said collar has a rebate in the outer rear face thereof corresponding to said circlip, thereby preventing said circlip from being dislodged when the system as a whole is pressurised.

9. An airgun according to claim 6, including a refill valve which is in communication with said expansion chamber, allowing the pressure of said expansion chamber to be increased or decreased.

10. An airgun according to claim 9 wherein said refill valve is located in said collar.

11. An airgun according to claim 1, wherein said inner cylindrical member is a cylinder having a closed end and an open end, said open end of said inner cylinder being relatively closer to said barrel than said closed end, said piston interior being in communication with the interior of said inner cylinder via said open end of said inner cylinder.

12. An airgun according to claim 1, wherein said inner cylindrical member is solid.

13. An airgun according to claim 1, wherein said gas in said expansion chamber is at a substantially higher pressure than atmosphere when said piston is in said uncocked position.

14. An airgun according to claim 1, wherein said cocking mechanism includes a cocking lever which is arranged to urge said piston to said cocked position.

15. An airgun according to claim 14, wherein said barrel is pivotable and said cocking lever is linked to said barrel whereby said barrel constitutes a convenient form of extended lever to apply a cocking force to said piston via said cocking lever.

16. An airgun according to claim 1, including a refill valve which is in communication with said expansion chamber, allowing the pressure of said expansion chamber to be increased or decreased.

17. An airgun according to claim 16 wherein said refill valve is located to said collar.

18. An airgun according to claim 1 wherein the compression ratio between its cocked and uncocked states is between 1.1:1 and about 1.15:1.

19. An airgun according to claim 1, including a second piston and a second inner cylindrical member, said second piston being arranged to move in the opposite direction to said piston on firing.

* * * * *

UNITED STATES PATENT AND TRADEMARK OFFICE

CERTIFICATE OF CORRECTION

PATENT NO. : 5,193,517

DATED : March 16, 1993

INVENTOR(S) : Hugh F. Taylor and David R. Theobald

It is certified that error appears in the above-indentified patent and that said Letters Patent is hereby corrected as shown below:

On the title page, Item [30] Foreign Application Priority Data

--June 8, 1990 [GB] United Kingdom 9012829.9--

Signed and Sealed this

Eighth Day of February, 1994

Bruce Lehman

*Attest:*

BRUCE LEHMAN

*Attesting Officer*

*Commissioner of Patents and Trademarks*